US008668293B2

(12) United States Patent
Harada

(10) Patent No.: US 8,668,293 B2
(45) Date of Patent: Mar. 11, 2014

(54) LIQUID EJECTING APPARATUS

(75) Inventor: Koji Harada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 302 days.

(21) Appl. No.: 12/907,875

(22) Filed: Oct. 19, 2010

(65) Prior Publication Data

US 2011/0090267 A1 Apr. 21, 2011

(30) Foreign Application Priority Data

Oct. 21, 2009 (JP) ..... 2009-242163

(51) Int. Cl.
*B41J 29/38* (2006.01)
*B41J 2/195* (2006.01)
*B41J 2/165* (2006.01)

(52) U.S. Cl.
USPC ..... 347/6; 347/7; 347/22; 347/23; 347/28

(58) Field of Classification Search
USPC ..... 347/6–7, 9, 14, 22–23, 28
See application file for complete search history.

(56) References Cited

U.S. PATENT DOCUMENTS

| | | | | |
|---|---|---|---|---|
| 2005/0068349 | A1* | 3/2005 | Matsumoto et al. | 347/7 |
| 2007/0076063 | A1 | 4/2007 | Ohnishi et al. | |
| 2009/0115815 | A1* | 5/2009 | Uda et al. | 347/28 |
| 2009/0251506 | A1 | 10/2009 | Ohnishi et al. | |

FOREIGN PATENT DOCUMENTS

| | | | |
|---|---|---|---|
| JP | 63-260451 | A | 10/1988 |
| JP | 10-034970 | A | 2/1998 |
| JP | 2001-334684 | A | 12/2001 |
| JP | 2004-230857 | A | 8/2004 |
| JP | 2007-268997 | A | 10/2007 |

* cited by examiner

*Primary Examiner* — Jason Uhlenhake
(74) *Attorney, Agent, or Firm* — Kilpatrick Townsend & Stockton LLP

(57) ABSTRACT

A liquid ejecting apparatus that ejects liquid from an ejecting nozzle provided in an ejecting head includes a first container that contains a first liquid and a second container that contains a second liquid. The liquid ejecting apparatus includes a channel that selectively communicates with either the first or second container to supply the liquid contained therein to the ejecting head, a switching unit that performs a switching operation of switching between a first communicating state in which the channel communicates with the first container and a second communicating state in which the channel communicates with the second container. In addition, if the remaining amount of the second liquid contained in the second container is less than a predetermined value, prohibits the switching unit from performing the switching operation of switching from the second communicating state to the first communicating state.

4 Claims, 5 Drawing Sheets

LIQUID EJECTING APPARATUS

This application claims priority to Japanese Patent Application No. 2009-242163, filed Oct. 21, 2009, the entirety of which is incorporated by reference herein.

BACKGROUND

1. Technical Field

The present invention relates to a technique for ejecting a liquid from an ejecting nozzle.

2. Related Art

A liquid ejecting apparatus that ejects a liquid such as ink from an ejecting head provided with a minute ejecting nozzle is known. In this liquid ejecting apparatus, the liquid to be ejected (for example, ink) is contained in a dedicated container (for example, an ink cartridge), and the liquid in the container is supplied to the ejecting head through a channel to be ejected.

In addition, the liquid to be ejected may contain an ingredient having a tendency to settle. For example, if the liquid to be ejected is ink, a pigment may be used for the purposes of enhancing so-called weather resistance, improving a color forming property, and the like. Since a pigment is not dissolved but suspended in a solvent of ink (such as water and alcohol), it gradually settles in the solvent when the ink is left unused for a long period. If the liquid ejecting apparatus is left unused with an ingredient having a tendency to settle left in the ejecting head and the channel, clogging may occur inside the ejecting head and the like as the pigment settles. Accordingly, a problem such as liquid ejection failure may arise.

To solve the above problem, JP-A-2007-268997 proposes a technique in which a liquid that may cause clogging is discharged from an ejecting head and a channel by separately loading another container, which is replaceable as a dedicated container such as an ink cartridge is, and ejecting a cleaning liquid contained in the other container from an ejecting nozzle.

However, there still is a problem in that the occurrence of clogging in the ejecting head and the channel cannot completely be prevented even when the proposed technique is applied. In other words, to avoid clogging using the proposed technique, a sufficient amount of the cleaning liquid must be ejected from the ejecting nozzle. However, there may be a case where the remaining amount of the cleaning liquid in the container containing the cleaning liquid is not sufficient to complete the task. It is needless to say that, even in such a case, the occurrence of clogging can be avoided if a sufficient amount of the cleaning liquid is prepared by replacing the container for containing the cleaning liquid, or by some other action. However, it is not ensured that a sufficient amount of the cleaning liquid is always prepared by constantly replacing the container or by some other action whenever the amount of the cleaning liquid becomes insufficient. There still is a problem in that the occurrence of clogging in the ejecting head and the channel cannot completely be prevented even if the proposed technique is applied.

SUMMARY

An advantage of some aspects of the invention is the provision of a technique that can be used to avoid such a problem of not being able to eject a liquid from an ejecting nozzle due to clogging or the like in an ejecting head.

To solve the above problem at least partly, a liquid ejecting apparatus according to an aspect of the invention mainly adopts the following configuration. A liquid ejecting apparatus that ejects liquid from an ejecting nozzle provided in an ejecting head includes a first container that contains a first liquid and a second container that contains a second liquid that is supplied to the ejecting head in order to maintain a state in which the liquid is ejectable from the ejecting nozzle. The liquid ejecting apparatus also includes a channel that selectively communicates with either the first or second container to supply the liquid contained therein to the ejecting head, a switching unit that performs a switching operation of switching between a first communicating state in which the channel communicates with the first container and a second communicating state in which the channel communicates with the second container, and a liquid replacing unit that, when the switching operation is performed by the switching unit, causes the ejecting head to discharge the liquid having been supplied from the container that communicated with the ejecting head through the channel before the switching operation was performed, and causes the ejecting head to be supplied with the liquid contained in the container that newly communicated with the ejecting head through the channel using the switching operation. In addition, the liquid ejecting apparatus includes a remaining amount detecting unit that detects a remaining amount of the second liquid contained in the second container, and a switching operation prohibiting unit that, if the remaining amount detected by the remaining amount detecting unit is less than a predetermined value, prohibits the switching unit from performing the switching operation of switching from the second communicating state to the first communicating state.

In addition, a method of controlling a liquid ejecting apparatus according to another aspect of the invention corresponding to the above-described liquid ejecting apparatus is mainly described as follows. The method is applied to the liquid ejecting apparatus including an ejecting head that ejects liquid from an ejecting nozzle, a first container that contains a first liquid, and a second container that contains a second liquid that is supplied to the ejecting head in order to maintain a state in which the liquid is ejectable from the ejecting nozzle. The method is used to switch between a state in which the first liquid is ejectable from the ejecting nozzle and a state in which the second liquid has been supplied to the ejecting head. The method includes detecting a remaining amount of the second liquid contained in the second container, performing a switching operation of switching between a first communicating state in which the ejecting head communicates with the first container and a second communicating state in which the ejecting head communicates with the second container, and replacing the liquid, when the switching operation is performed, by causing the ejecting head to discharge the liquid having been supplied from the container that communicated with the ejecting head before the switching operation was performed, and by causing the ejecting head to be supplied with the liquid contained in the container that newly communicated with the ejecting head by the switching operation. In the method, if the remaining amount detected by the detecting of the remaining amount is less than a predetermined value, the switching operation is prohibited from switching from the second communicating state to the first communicating state.

In the liquid ejecting apparatus and the method of controlling the liquid ejecting apparatus according to the aspects of the invention, either one of the first container containing the first liquid and the second container containing the second liquid communicates with the ejecting head. In the first communicating state in which the ejecting head communicates with the first container, the first liquid can be supplied to the ejecting head. In contrast, in the second communicating state in which the ejecting head communicates with the second container, the second liquid can be supplied to the ejecting head.

When the switching operation of switching from the first communicating state to the second communicating state is performed, the first liquid is discharged from the ejecting head and the like, and the second liquid is supplied to the ejecting head. Here, the second liquid is a liquid that is supplied to the ejecting head in order to maintain a state in which the liquid is ejectable from the ejecting nozzle. If such a second liquid is supplied to the ejecting head, a desirable state in which the liquid is ejectable from the ejecting nozzle can reliably be maintained.

In contrast, when the switching operation of switching from the second communicating state to the first communicating state is performed, the second liquid is discharged from the ejecting head and the like, and the first liquid is supplied to the ejecting head. Before this switching operation is performed, the ejecting head and the like is supplied with the second liquid as described above, thereby maintaining the ejecting nozzle in a desirable state without causing clogging in the ejecting head and the like. Therefore, the first liquid can be ejected from the ejecting nozzle after the switching operation of switching to the first communicating state has been performed.

In addition, in the liquid ejecting apparatus and the method of controlling the liquid ejecting apparatus according to the aspects of the invention, if the remaining amount of the second liquid is less than the predetermined value, the switching operation of switching from the second communicating state to the first communicating state is prohibited. Switching from the second communicating state to the first communicating state can be performed only when the remaining amount of the second liquid is equal to or more than the predetermined value. Therefore, a situation such as switching from the first communicating state to the second communicating state when the remaining amount of the second liquid is insufficient can be avoided before such a situation occurs. When the communicating state is switched to the second communicating state, if a sufficient amount of the second liquid can be ensured, the second liquid can be reliably supplied to the ejecting head. Thus, problems such as clogging in the ejecting head can be avoided before they occur.

In addition, it is preferable that the predetermined value in the liquid ejecting apparatus according to the aspect of the invention be set to be a value larger than a sum of the inner volumes of the channel and the liquid ejecting head.

By doing this, an amount of the second liquid larger than the sum of the inner volumes of the channel and the liquid ejecting head can be ensured when switching from the first communicating state to the second communicating state is performed. If an amount of the second liquid larger than the above sum of the inner volumes is supplied to the ejecting head, the internal portion of the ejecting head and the channel can almost completely be filled with the second liquid. Thus, it becomes possible that the first liquid is almost completely discharged from the channel and the ejecting head. If the first liquid can almost completely be discharged from the channel and the ejecting head, problems such as clogging in the head can more reliably be avoided.

In addition, in the liquid ejecting apparatus and the method of controlling thereof according to the aspects of the invention, it is preferable that the liquid in the ejecting head be replaced in the following method. First, a capping member is provided. The capping member that is brought into contact with a portion where the ejecting nozzle is formed (nozzle surface) in an outer surface of the ejecting head forms a closed space around the ejecting nozzle. A suction pump, which is connected to the capping member and capable of applying a negative pressure to the closed space, is also provided. When the switching operation is performed by the switching unit, the liquid replacing unit may cause the suction pump to actuate while keeping the capping member in contact with the nozzle surface in order to suck the liquid from the ejecting nozzle. By doing this, the ejecting head is caused to discharge the liquid having been supplied from the container that communicated with the ejecting head before the switching operation was performed, and is provided with the liquid contained in the container that newly communicated with the ejecting head by the switching operation.

If such a capping member is provided, possible progress of drying of the liquid in the ejecting nozzle can be suppressed by keeping the capping member in contact with the nozzle surface while liquid ejection is not performed. When the switching operation is performed, the liquid supplied to the ejecting head and the like can be replaced only by actuating the suction pump while keeping the capping member in contact with the nozzle surface.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment will be described below in the following order to clarify the contents according to the aspects of the invention described above.

Figure 1:
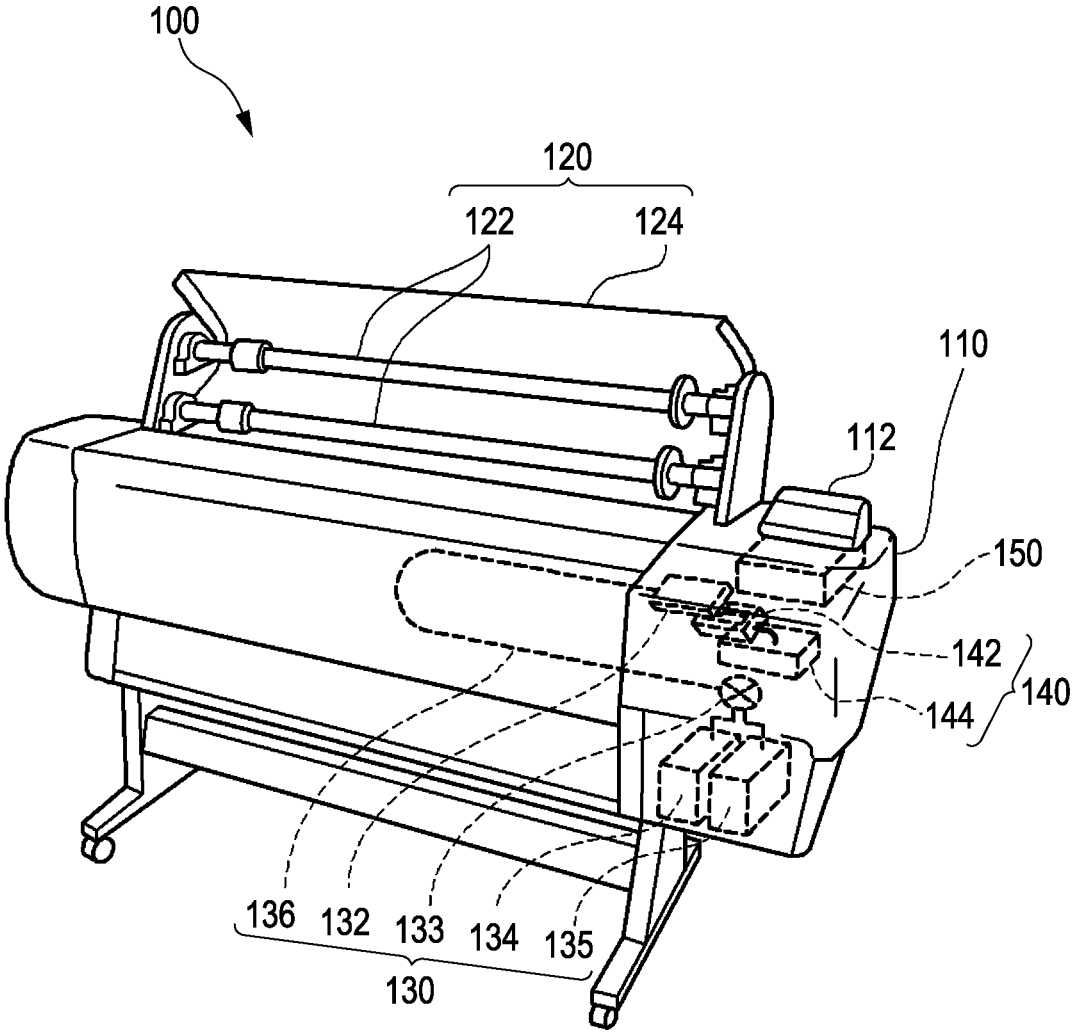
FIG. 1 is an explanatory diagram illustrating an ink jet printer as a liquid ejecting apparatus of this embodiment.

A. Configuration of apparatus
B. Outline of printing operation
C. Shutdown process
D. Startup process A. Configuration of Apparatus FIG. 1 is an explanatory diagram illustrating an example of an ink jet printer 100 as a liquid ejecting apparatus of this embodiment. The ink jet printer 100 illustrated in the figure is a large format printer (LFP) that is used for printing on so-called large size printing paper such as JIS A1 size paper and JIS B1 size paper. However, the ink jet printer 100 may be a printer for home use used to print on smaller size printing paper such as JIS A4 size paper and postcard size paper.

As illustrated in the figure, the ink jet printer 100 generally includes a body casing 110, a paper supply portion 120 provided on a top side of the body casing 110 and to be loaded with printing paper, and so forth.

The paper supply portion 120 includes spindles 122, a cover 124, and the like. The spindles 122 are axial members rotatably supported at both ends thereof, to which roll printing paper (hereinafter referred to as roll paper) is attached. In addition, roll paper stoppers being slidable in the axial direction are provided at both ends of the spindles 122. With these stoppers, the roll paper attached to the spindles 122 can be secured so as not to move in the axial direction. Furthermore, a flip-up type cover 124 is provided so as to prevent the roll paper attached to the spindles 122 from being stained. To attach the roll paper to the spindles 122, the flip-up type cover 124 is flipped up to expose the spindles 122. The roll paper is attached to the spindles 122 taken out of the paper supply portion 120. Then, after the spindles 122 with the roll paper attached thereto have been set in the paper supply portion 120, the end of the flip-up type cover 124 is pressed down to close the flip-up type cover 124. By doing this, staining of the roll paper loaded in the paper supply portion 120 can be prevented.

In a lower portion on a side of the body casing 110, a power switch, which is not shown, is provided. The power switch is used to supply and cut off the power from an external power source to the ink jet printer 100. In addition, on the top surface of the body casing 110, an operation panel 112, which allows a user to operate the ink jet printer 100, is provided. In the operation panel 112, a display screen (not shown) that includes a liquid crystal display unit and the like, a variety of operation buttons (not shown), and the like are arranged. A main button, which is initially operated in starting up the ink jet printer 100, is also included in the variety of operation buttons.

In a state where the power switch is turned off (power-off state), the ink jet printer 100 of this embodiment consumes almost no power as a result of stopping of various functions of the ink jet printer 100 except for minimum functions (for example, holding data indicating a state of the ink jet printer 100, measuring elapsed time, and the like). In addition, while the power switch is turned on, states such as a printing state where a printing operation is being performed, a standby state where a printing operation can be started in response to reception of printing data, and an idle state where only the main button can be operated are set. In the ink jet printer 100, the standby state is initially set when the power switch is switched on. When the printing data is received in the standby state, the printing operation begins and the state changes to the printing state, and the state returns to the standby state when the printing operation ends. In addition, the ink jet printer 100 is configured such that the idle state is set when the main button is operated in the standby state, and the standby state is again set when the main button is operated in the idle state.

In the standby state, the ink jet printer 100 can be operated by checking the display screen and operating the operation buttons in the operation panel 112. In the state where the power switch is turned on, messages that notify the user of a necessity for maintenance such as replacement of a cartridge and cleaning are displayed as needed on the display screen. Such messages are displayed in the printing state and the standby state, and also displayed when the power switch is switched on and when the main button is operated in the idle state.

Figure 2:
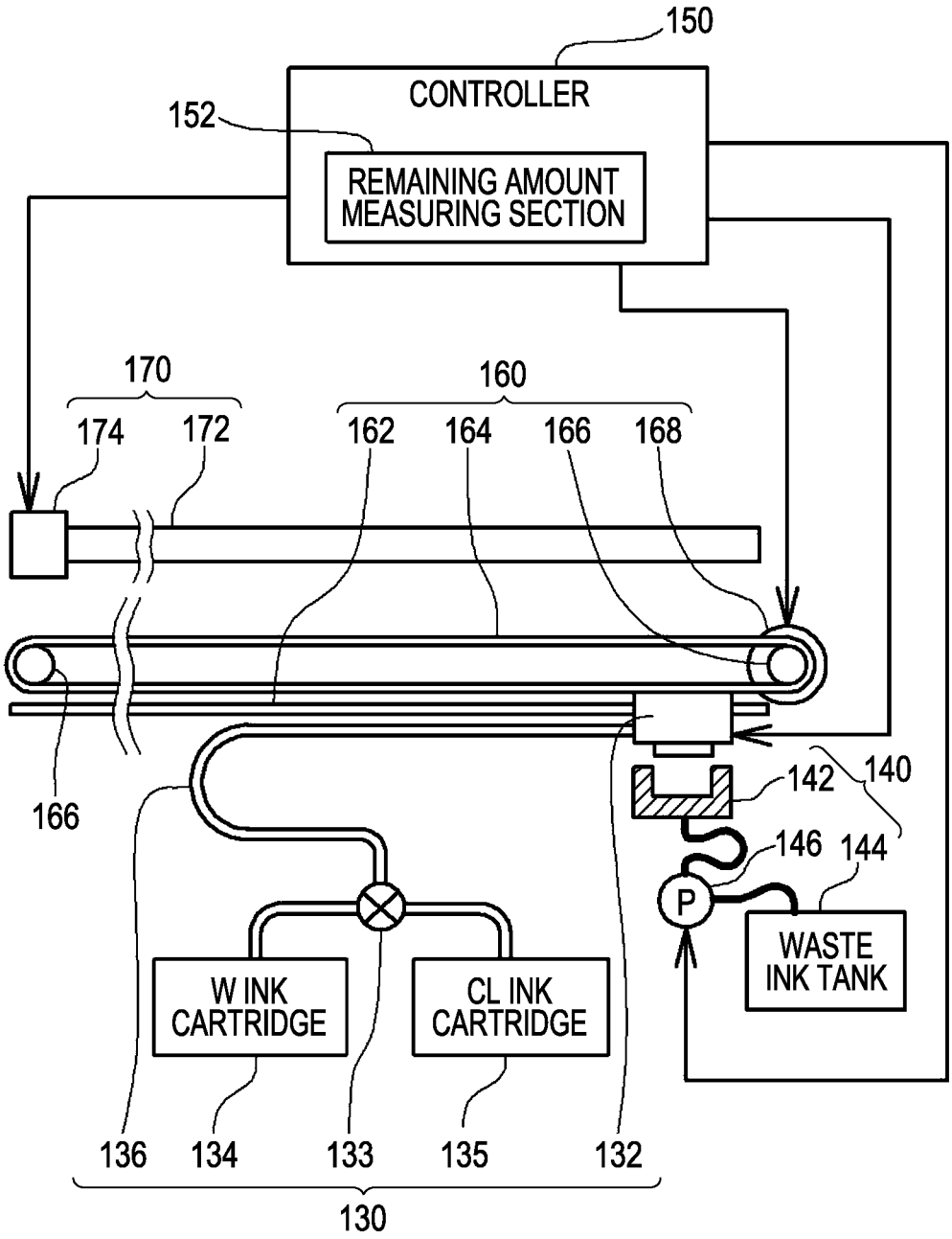
FIG. 2 is an explanatory diagram illustrating a general configuration inside the ink jet printer of this embodiment.

FIG. 2 is a diagram illustrating a general internal configuration of the ink jet printer 100. The body casing 110 includes the following components that are mounted therein. The components are an ink ejecting portion 130 including an ejecting head 132 that ejects ink, an ink maintenance portion 140 that performs ink state management such as prevention of drying of the ink, a driver portion 160 that causes the ejecting head 132 to perform reciprocating motion, a paper feeding portion 170 that feeds the roll paper, a controller 150 that controls operations of the entirety of the ink jet printer 100, and so forth.

As illustrated in FIG. 2, the ink ejecting portion 130 includes the ejecting head 132 that ejects the ink, a white ink (W ink) cartridge 134 that contains printing ink used to print images (here, the W ink represents a variety of types of printing inks), a cleaner ink (CL ink) cartridge 135 that contains a reserve ink (cleaning liquid) used to prevent clogging inside the ejecting head 132 and the like, an ink tube 136 that channels the W ink or the CL ink to the ejecting head 132, a pressurizing mechanism (not shown) that pumps the W ink or the CL ink toward the ejecting head 132, and the like. Here, both the W ink and the CL ink are liquids supplied to the ejecting head 132. In the descriptions of this embodiment, the term "ink" broadly refers to inks including not only the W ink that is a printing ink but also the CL ink that is a reserve ink.

In the ejecting head 132, a plurality of minute ejecting nozzles are provided in the surface of a side opposing the printing paper. For example, character printing and image printing on the printing paper can be performed by ejecting the W ink through the ejecting nozzles. In the side of the ejecting head 132, which opposes the printing paper, the surface of a portion where the plurality of ejecting nozzles are formed is referred to as a "nozzle surface."

Each of the W ink cartridge 134 and the CL ink cartridge 135 has an integrated circuit (IC) chip (not shown) that stores information such as the type of ink contained and the amount of ink contained in the cartridge before shipment. The data of the contained amount stored in the IC chip is read by the ink jet printer 100 side when the cartridge is newly loaded. The read data is stored in the controller 150 as latest remaining amount data corresponding to that cartridge.

The W ink cartridge 134 and the CL ink cartridge 135 are connected to the ink tube 136 through a three-way valve 133 used to switch channels. By using the three-way valve 133, a communicating state in which the ink tube 136 and the W ink cartridge 134 communicate and another communicating state in which the ink tube 136 and the CL ink cartridge 135 communicate can be switched between each other. The ink jet printer 100 is configured so that either the W ink contained in the W ink cartridge 134 or the CL ink contained in the CL ink cartridge 135 is supplied to the ejecting head 132 by an operation of the aforementioned pressurizing mechanism when the cartridge containing the W ink or the CL ink communicates with the ink tube 136.

In addition, the ink maintenance portion 140 includes a cap 142 provided with a depression that is formed in the center thereof, a waste ink tank 144 that receives waste ink, and the like. A driving mechanism (not shown) can cause the cap 142 to move into contact with and move out of contact with the nozzle surface of the ejecting head 132. The cap 142 is in contact with the nozzle surface in both the standby state and idle state in which the printing operation is not performed. In a state where the cap 142 is in contact with the nozzle surface, drying of the ink can be suppressed by covering the ejecting nozzles with the cap 142. If a suction pump 146 is operated while the cap 142 is kept in contact with the nozzle surface of the ejecting head 132, the ink in the ejecting nozzles can be sucked by decreasing the pressure in the depression of the cap 142 to a negative value. In addition, in such a case where drying of the W ink in the ejecting nozzles has progressed in the printing state, it is possible to eject the W ink from the ejecting head 132 toward the depression of the cap 142. The waste ink discharged from the ejecting nozzles of the ejecting head 132 in this manner flows into the waste ink tank 144 through a tube and is received in the waste ink tank 144.

Here, in the ink jet printer 100 of this embodiment, the sum of the inner volumes of the ink tube 136 and the ejecting head 132 is set as a volume Vm. Therefore, in the ink jet printer 100, the ink in the ejecting head 132 and the ink tube 136 can completely be replaced by sucking an amount of ink equal to the volume Vm from the ejecting nozzles.

The driver portion 160 includes a guide rail 162 that guides the reciprocating motion of the ejecting head 132, a driving belt 164 that reciprocates the ejecting head 132 along the guide rail 162, a pair of pulleys 166 around which the driving belt 164 is stretched, a driving motor 168 that drives the driving belt 164, and so forth. The ejecting head 132 is fixed to a position in the driving belt 164. Thus, when the driving belt 164 is run by rotating the driving motor 168 in the positive or negative direction, the ejecting head 132 performs the reciprocating motion while being guided by the guide rail 162. The length of the ink tube 136 that supplies the ink to the ejecting head 132 is determined such that the length is sufficient to accommodate the reciprocating motion of the ejecting head 132 as described above.

The paper feeding portion 170 includes a paper feeding roller 172 provided in parallel with the guide rail 162, a paper feeding motor 174 that rotates the paper feeding roller 172, an idle roller (not shown) provided alongside the paper feeding roller 172, and the like. The paper feeding roller 172 is formed of a long columnar member having a length that traverses the roll paper in a width direction. When the roll paper is loaded in the paper supply portion 120, one end of the roll paper is advanced to a position of the paper feeding roller 172 and inserted into a pinch between the paper feeding roller 172 and the idle roller. The roll paper is in a state where the roll paper is pressed onto the paper feeding roller 172 by the idle roller with an adequate force. When the paper feeding motor 174 is rotated in this state, the roll paper is gradually drawn out and fed toward the ejecting head 132 as the paper feeding roller 172 rotates.

Operations of the driving motor 168 and the paper feeding motor 174 are controlled by the controller 150. In addition, an ink ejecting operation of the ejecting head 132 and a switching operation of the three-way valve 133 are also performed under the control of the controller 150. Furthermore, the aforementioned operations of moving the cap 142 into contact with the nozzle surface of the ejecting head 132 and of sucking the ink from the ejecting nozzles by operating the suction pump 146 with the cap 142 kept in contact with the nozzle surface are also performed under the control of the controller 150. Thus, the controller 150 is related to almost all of the operations performed in the ink jet printer 100.

In addition, the controller 150 stores specification data such as the amount of the ink per droplet ejected from the ejecting head 132 and suction capacity of the suction pump 146. The controller 150 includes the remaining amount measuring section 152 that can obtain an exact consumed amount of each W ink and the CL ink having been consumed by using the specification data in combination with control data such as the number of times the ejecting head 132 has performed ejection and the operating time of the suction pump 146. As described above, the amount contained in a newly replaced cartridge is stored in the controller 150 as the latest remaining amount data at the time. Thus, the remaining amount measuring section 152 detects the remaining amount in each of the cartridges with good accuracy by subtracting a consumed amount as needed from the remaining amount data stored in the controller 150 separately for each of the cartridges every time the W ink and the CL ink is consumed. By updating the remaining amount data stored in the controller 150 every time the remaining amount is detected as described above, the remaining amount in each of the cartridges can be obtained with high accuracy. It is noted that to store the remaining amount data in the controller 150, for example, a nonvolatile memory such as a flash read only memory (flash ROM) is preferably utilized. By doing this, the remaining amount data of each cartridge can reliably be held even when the power switch is switched off afterward.

B. Outline of Printing Operation

Figure 3A:
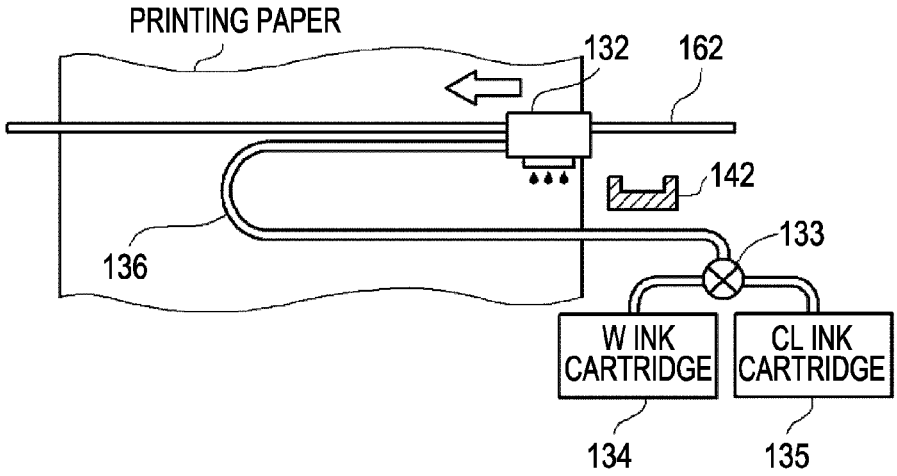
FIGS. 3A to 3C are explanatory diagrams conceptually illustrating how the ink jet printer of this embodiment performs image printing while reciprocating an ejecting head.
Figure 3B:
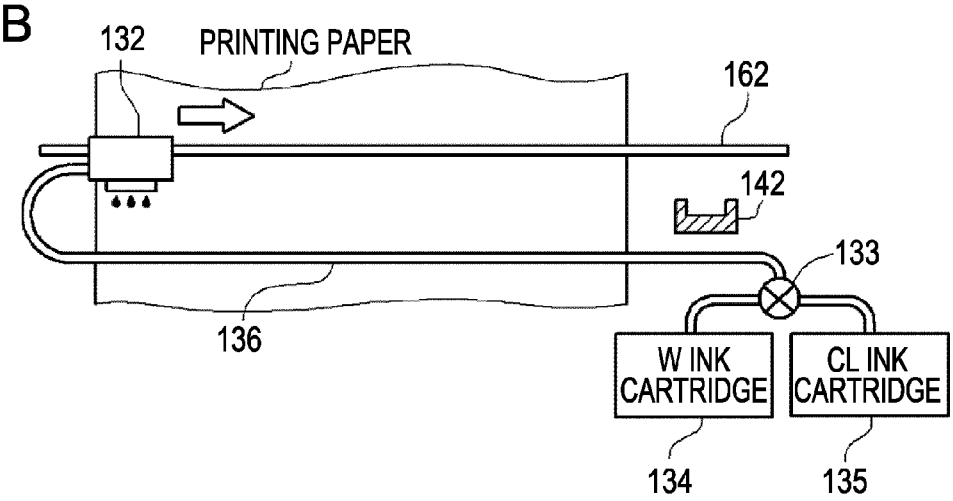
Figure 3C:
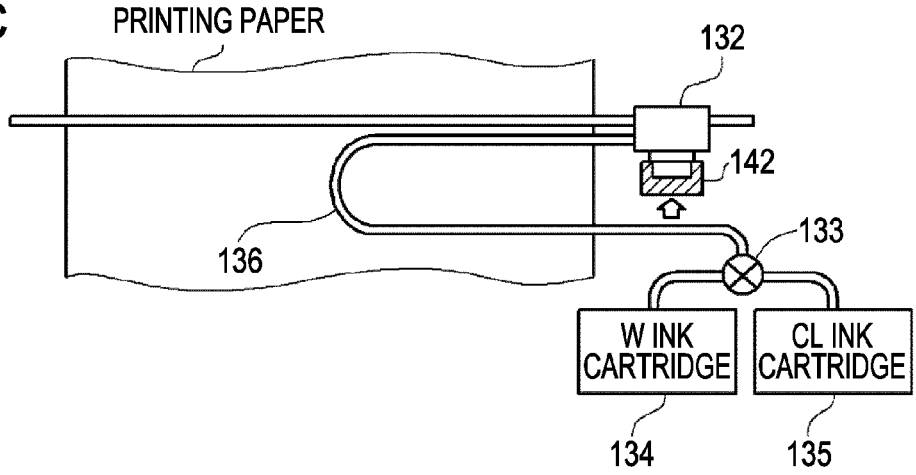

FIGS. 3A to 3C are conceptual diagrams illustrating how the ink jet printer 100 of this embodiment performs image printing by reciprocating the ejecting head 132. As illustrated in FIGS. 3A and 3B, the ejecting head 132 performs image printing by ejecting the W ink toward the printing paper (roll paper) while performing the reciprocating motion along the guide rail 162. Once printing ends, as illustrated in FIG. 3C, the ejecting head 132 is moved to a position of the cap 142. Then, the driving mechanism (not shown) pushes the cap 142 upward to be in contact with the nozzle surface of the ejecting head 132. By doing this, the ejecting nozzles can be covered by the cap 142. Therefore, phenomena such as evaporation of water and volatilization of a volatile ingredient from the W ink through openings of the ejecting nozzles can be prevented, and degradation of properties of the W ink can be suppressed.

C. Shutdown Process

Figure 4:
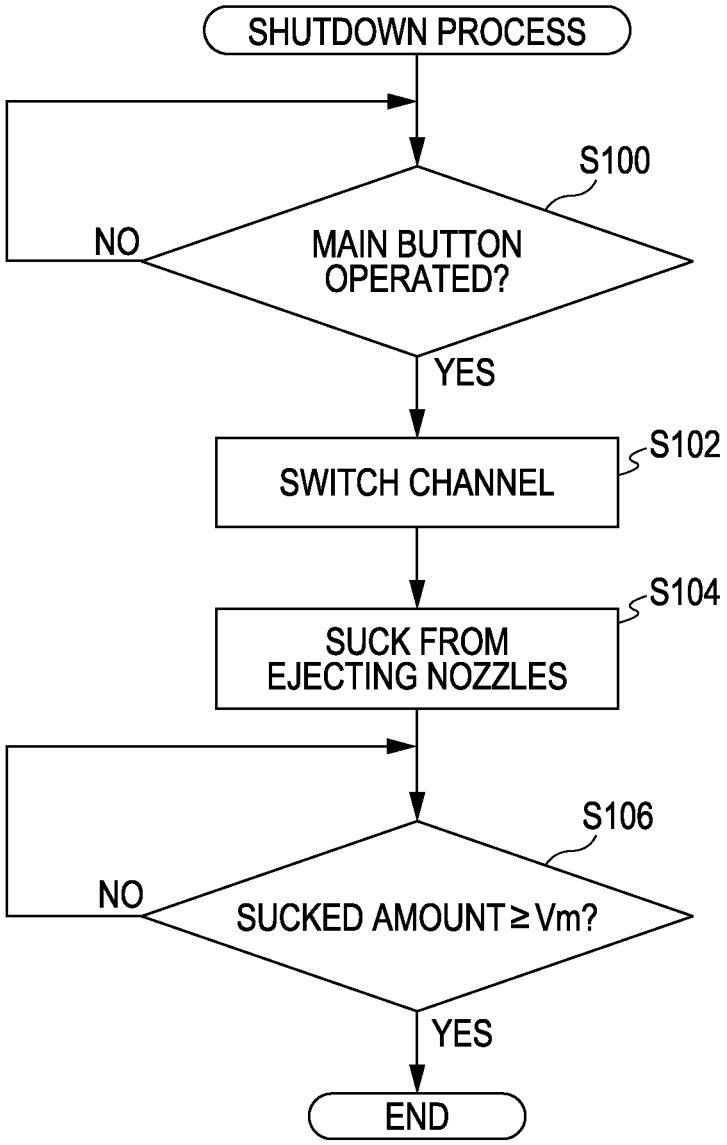
FIG. 4 is a flowchart of a shutdown process performed by the ink jet printer of this embodiment.

FIG. 4 is a flowchart illustrating a shutdown process performed when the state of the ink jet printer 100 of this embodiment transitions from the standby state to the idle state. In this shutdown process, whether or not the main button is operated is initially determined (step S100). In a time duration before the main button is operated (NO in step S100), the similar determination is repeated and the standby state is maintained without change. If it is determined that the main button is operated (YES in step S100), channel switching using the three-way valve 133 is performed (step S102).

Since the shutdown process illustrated in FIG. 4 is performed during the transition from the standby state to the idle state, in the channel switching in step S102, the switching operation is performed to switch the communicating state from a communicating state in which the ejecting head 132 communicates with the W ink cartridge 134 to another communicating state in which the ejecting head 132 communicates with the CL ink cartridge 135. If the situation here is that the user is operating the main button in an attempt to set the idle state, the ejecting nozzles are covered with the cap 142 in response to the end of the printing operation as illustrated in FIG. 3C. Therefore, suction from the ejecting nozzles can be performed by actuating the suction pump 146 to cause a negative pressure to be applied to the depression of the cap 142 (step S104). If the W ink is sucked from the ejecting nozzles as above, the CL ink in the CL ink cartridge 135 being in communication with the ejecting head 132 due to the switching operation can be supplied to the ejecting head 132 following a discharge of the W ink, which was supplied to the ejecting head 132, from the ejecting nozzles.

The operation that sucks the W ink from the ejecting nozzles is continued until a sucked amount becomes equal to or more than Vm or the sum of the inner volumes of the ink tube 136 and the ejecting head 132 (NO in step S106). Then, if the sucked amount becomes Vm or more (YES in step S106), it is determined that the operation that replaces the total amount of the W ink in the ejecting head 132 and the ink tube 136 with the CL ink has been completed, and accordingly, the suction operation ends. As described above, at least Vm of the CL ink is consumed every time the shutdown process is performed. It is noted that the description here refers to one type of printing ink or the W ink to represent printing inks In actuality, a plurality of printing inks are in use. Therefore, in a case where the number of the cap 142 provided is one, and if those plurality of printing inks are also replaced with the CL ink, a corresponding amount of the CL ink is consumed (if the sum of the inner volumes of the ink tube 136 and the ejecting head 132 is the same as that of the W ink, the volume is given by Vm multiplied by the number of types of inks that are replaced).

When the idle state can be set, in which the CL ink is supplied inside the ink tube 136 and the ejecting head 132 as described above, the likelihood of clogging occurring in the ejecting head 132 and the ink tube 136 can be considerably suppressed in the case where no image printing is performed afterward, or even in the case where the power switch is turned off in such a state and the ink jet printer 100 is left unused for a long period. Thus, if a clog-free state is maintained in the ejecting head 132 and the like, the printing operation can immediately be started afterward without performing maintenance work especially on such components as the ejecting head 132 and the ejecting nozzles.

D. Startup Process

Figure 5:
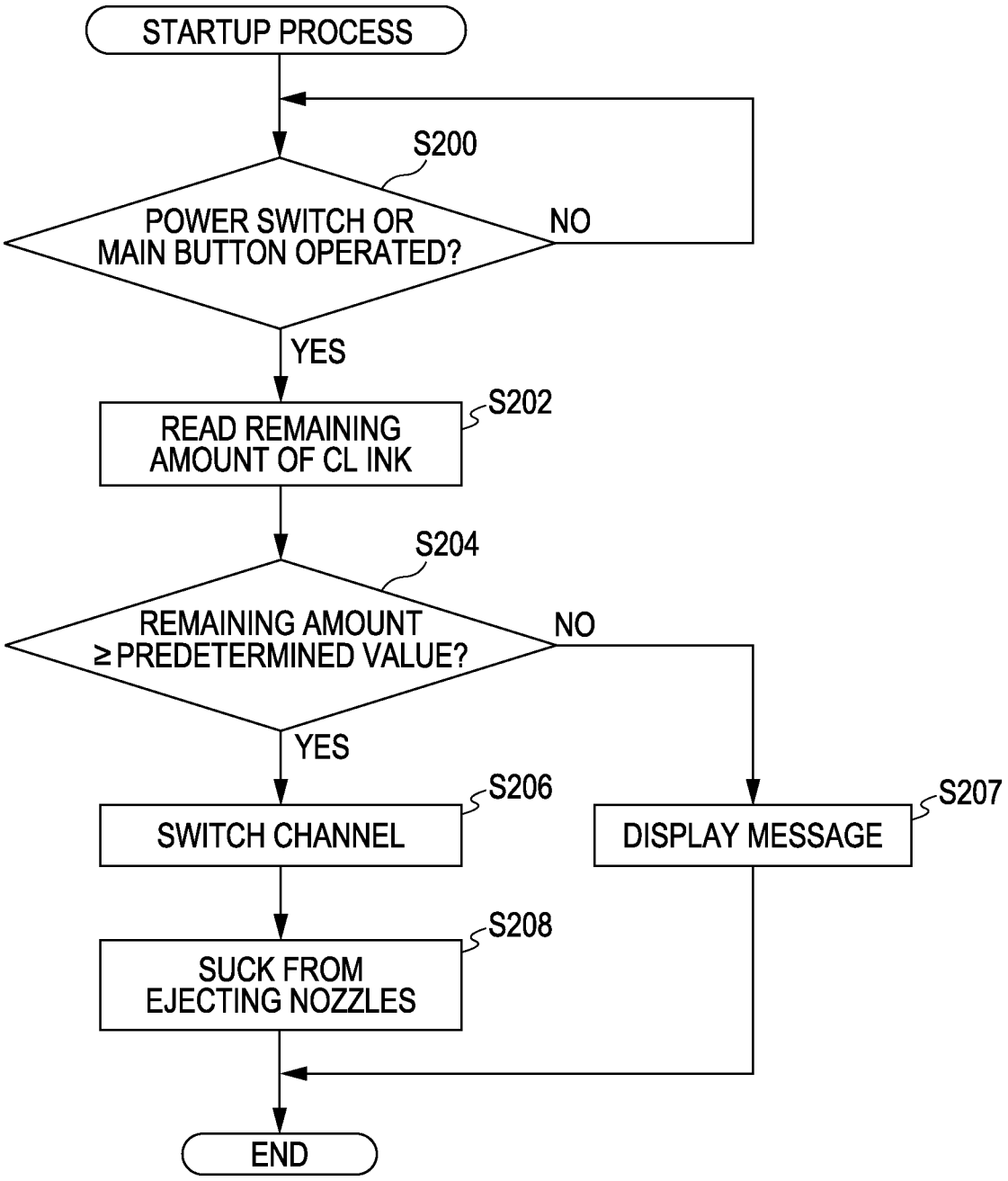
FIG. 5 is a flowchart of a startup process performed by the ink jet printer of this embodiment.

FIG. 5 is a flowchart illustrating a startup process performed by the ink jet printer 100 of this embodiment to set the standby state by starting up an internal system. The startup process is performed when the power switch is switched on, or when the main button is operated in the idle state. In this startup process, whether or not the power switch or the main button is operated is initially determined (step S200). If the power switch is switched on, or the main button is operated in the idle state (YES in step S200), the remaining amount data, which is stored in relation to the CL ink cartridge 135 in the controller 150, is read (step S202), and a threshold process is performed on that remaining amount data (step S204). In this threshold process, whether or not the remaining amount of the CL ink is equal to or more than a predetermined value is determined. In this embodiment, an amount of the CL ink required in one shutdown process (that is, Vm or the sum of the inner volumes of the ink tube 136 and the ejecting head 132) is set as the predetermined value.

If the remaining amount of the CL ink is equal to or more than the predetermined value (YES in step S204), the channel switching is performed using the three-way valve 133 (step S206). In this channel switching, the switching operation is performed to switch from the communicating state in which the ejecting head 132 communicates with the CL ink cartridge 135 to the communicating state in which the ejecting head 132 communicates with the W ink cartridge 134. Then, the suction from each of the ejecting nozzles is performed by actuating the suction pump 146 to cause a negative pressure to be applied to the depression of the cap 142 (step S208). When the suction starts, the CL ink is initially discharged from the ejecting nozzles since the ejecting head 132 and the ink tube 136 are filled with the CL ink. However, as the CL ink is discharged, the W ink can be supplied to the ejecting head 132. At the time, if the suction amount from the ejecting nozzles is set to Vm, the CL ink in the ejecting head 132 and the ink tube 136 can be replaced with the W ink. By doing this, the startup process normally ends, and the standby state where immediate printing is possible is set.

In contrast, if the remaining amount of the CL ink is less than the predetermined value (NO in step S204), a message that indicates necessity of replacement of the CL ink cartridge 135 is displayed on the display screen (step S207). In such a case, the startup process ends without the channel switching operation (step S206) and an operation where the CL ink is sucked from the ejecting nozzles to be replaced with the W ink (step S208) being performed. In such a case, the standby state is not set, but the ink jet printer 100 remains in the idle state. In other words, in the startup process of this embodiment, although the process is one that replaces the CL ink with the W ink, the remaining amount of the CL ink is detected instead of that of the W ink. Therefore, even if a sufficient amount of the W ink remains, the startup process ends without replacing the CL ink with the W ink in a case where the remaining amount of the CL ink is insufficient. As a result, the ink jet printer 100 is not set to the standby state, either.

As described above, the ink jet printer 100 of this embodiment is configured such that, even when a remaining amount of the W ink is sufficient, the standby state itself cannot be set in such a case where the CL ink is not sufficient to perform the shutdown process in returning to the idle state if the standby state is set. As a result, a situation where the W ink remains inside the ejecting head 132 and the ink tube 136 can be avoided before it occurs. Such a situation may otherwise occur when printing ends and the shutdown process starts, because a complete replacement of the W ink fails due to the insufficient CL ink.

In addition, when the startup process starts, the ejecting head 132 and the ink tube 136 are filled with the CL ink. Therefore, when the remaining amount of the CL ink is detected at this stage and found to be insufficient, by ending the startup process without replacing the CL ink with the W ink to avoid setting the standby process, a possibility that clogging occurs in the ejecting head 132 and the like is substantially eliminated even if the ink jet printer 100 is left unused. In addition, if the user is prompted to replace the CL ink cartridge 135 in this state, problems such as clogging in the ejecting head 132 which may otherwise occur in the ink jet printer 100 can be avoided before they occur.

If it can be assumed that the user follows the prompt to replace the CL ink cartridge 135, it is needless to say that the same advantage can be expected by prompting the replacement of the CL ink cartridge 135 in the shutdown process as by prompting the replacement of the CL ink cartridge 135 in the startup process. If the remaining amount of the CL ink is checked in the startup process, and the user is prompted to replace the CL ink cartridge 135 if needed, printing cannot be performed although a sufficient amount of the W ink for printing remains. In this sense, the user might consequently feel inconvenienced.

However, as a matter of fact, if the remaining amount of the CL ink is detected and the user is prompted to replace the CL ink cartridge 135 for the first time in the shutdown process, there is a possibility that the CL ink cartridge 135 is not replaced since printing has already ended. If the user is repeatedly prompted to replace the CL ink cartridge 135, the user may unplug the ink jet printer 100 in an extreme case. If the ink jet printer 100 is left unused without replacing the CL ink cartridge 135, and accordingly, without replacing the W ink in the ejecting head 132 and the ink tube 136 with the CL ink, clogging may occur in the ejecting head 132 and the ink tube 136. As a result, considerable time and effort is needed and a considerable amount of the CL ink is consumed when the user attempts to start printing next time. In the worst case, the ejecting head 132 and the ink tube 136 may need to be replaced.

In contrast, if the ink jet printer 100 is configured as in this embodiment, the ink jet printer 100 detects the remaining amount of the CL ink during the startup process. If the remaining amount is found to be insufficient, the ink jet printer 100 prompts the user to replace the CL ink cartridge 135 without replacing the CL ink with the W ink (and accordingly without setting the standby state). By doing this, printing cannot start unless the CL ink cartridge 135 is replaced. As a result, replacement of the CL ink cartridge 135 is ensured. This will eventually eliminate considerable time and effort which may otherwise be imposed on the user.

It is noted that the configuration of the ink jet printer 100 in this embodiment is especially effective when such a W ink that contains an ingredient having a tendency to settle such as a pigment for the purposes of enhancing so-called weather resistance and improving color forming properties is applied. This is because a pigment not dissolved but suspended in a solvent of ink (such as water and alcohol) gradually settles when the ink jet printer 100 is left unused with the W ink left in the ejecting head 132 and channels. Such a state tends to cause clogging inside the ejecting head 132 and the like, and therefore, tends to cause such a problem in that the ink jet printer 100 fails to eject the ink. It is needless to say that the W ink for which this configuration of the ink jet printer 100 is effective is not limited to such a W ink that contains an ingredient having a tendency to settle. The configuration of the ink jet printer 100 is also effective in a case where the W ink is an ink that easily thickens and solidifies, and accordingly, tends to cause clogging in the ejecting head 132.

In addition, in the above description, in the case where the standby state is switched to the idle state or in other cases, it is explained that the ink is sucked from the ejecting nozzles by actuating the suction pump 146. This operation can be performed for the following reason. When the ink jet printer 100 is in a state where printing is not performed, that is, in one of the standby state, the idle state and the power-off state, the cap 142 is in contact with the nozzle surface of the ejecting head 132 in order to suppress the ink from drying in the ejecting nozzles of the ejecting head 132, thereby allowing the ink to be sucked from the ejecting nozzles only by actuating the suction pump 146. The suction pump 146 is not necessarily used to suck the ink if the ink can be discharged from the ejecting nozzles. For example, the ink may be discharged by ejecting the ink from the ejecting nozzles toward the cap 142 while the cap 142 is kept in contact with the nozzle surface of the ejecting head 132, or in a state where the cap 142 is temporarily moved out of contact with the nozzle surface.

Although the embodiment according to the aspects of the invention and various modifications to the embodiment have been described above, the invention is not limited to the above embodiment and modifications but may be carried out in a variety of aspects without departing from the spirit of the invention.

What is claimed is:

1. A liquid ejecting apparatus that ejects liquid from an ejecting nozzle provided in an ejecting head, the liquid ejecting apparatus comprising:

a first container that contains a first liquid;

a second container that contains a second liquid that is supplied to the ejecting head in order to maintain a state in which the liquid is ejectable from the ejecting nozzle;

a channel that selectively communicates with either the first or second container to supply the liquid contained therein to the ejecting head;

a switching unit that performs a switching operation of switching between a first communicating state in which the channel communicates with the first container and a second communicating state in which the channel communicates with the second container;

a liquid replacing unit that, when the switching operation is performed by the switching unit, causes the ejecting head to discharge the liquid having been supplied from the container that communicated with the ejecting head through the channel before the switching operation was performed, and causes the ejecting head to be supplied with the liquid contained in the container that newly communicated with the ejecting head through the channel using the switching operation;

a remaining amount detecting unit that detects a remaining amount of the second liquid contained in the second container; and a switching operation prohibiting unit that, if the remaining amount detected by the remaining amount detecting unit is less than a predetermined value, wherein the predetermined value is larger than a sum of inner volumes of the channel and the liquid ejecting head, prohibits the switching unit from performing the switching operation of switching from the second communicating state to the first communicating state.

2. The liquid ejecting head according to claim 1, further comprising:

a display unit that displays a message that notifies that the remaining amount of the second liquid is insufficient when the switching operation of switching from the second communicating state to the first communicating state is prohibited by the switching operation prohibiting unit.

3. The liquid ejecting apparatus according to claim 1, further comprising:

a capping member that is brought into contact with a nozzle surface where the ejecting nozzle is arranged in an outer surface of the ejecting head to form a closed space around the ejecting nozzle; and a suction pump that applies a negative pressure to the closed space, wherein, when the switching operation is performed by the switching unit, the liquid replacing unit causes the suction pump to actuate while keeping the capping member in contact with the nozzle surface to suck the liquid from the ejecting nozzle so as to cause the ejecting head to discharge the liquid having been supplied from the container that communicated with the ejecting head before the switching operation was performed, and so as to cause the ejecting head to be supplied with the liquid contained in the container that newly communicated with the ejecting head by the switching operation.

4. A method of controlling a liquid ejecting apparatus applied to the liquid ejecting apparatus including an ejecting head that ejects liquid from an ejecting nozzle, a first container that contains a first liquid, and a second container that contains a second liquid that is supplied to the ejecting head in order to maintain a state in which the liquid is ejectable from the ejecting nozzle, the method used to switch between a state in which the first liquid is ejectable from the ejecting nozzle and a state in which the second liquid has been supplied to the ejecting head, the method comprising:

detecting a remaining amount of the second liquid contained in the second container;

performing a switching operation of switching between a first communicating state in which the ejecting head communicates with the first container and a second communicating state in which the ejecting head communicates with the second container; and replacing the liquid, when the switching operation is performed, by causing the ejecting head to discharge the liquid having been supplied from the container that communicated with the ejecting head before the switching operation was performed, and by causing the ejecting head to be supplied with the liquid contained in the container that newly communicated with the ejecting head by the switching operation, wherein, if the remaining amount detected by the detecting of the remaining amount is less than a predetermined value, wherein the predetermined value is larger than a sum of inner volumes of the channel and the liquid ejecting head, the switching operation is prohibited from switching from the second communicating state to the first communicating state.

* * * * *